US005706728A

United States Patent [19]

Motard et al.

[11] Patent Number: 5,706,728

[45] Date of Patent: Jan. 13, 1998

[54] PRINTING APPARATUS

[75] Inventors: Marcel Motard, Laval; Eric J. Short, Kirkland, both of Canada

[73] Assignee: RDP Marathon Inc., Quebec, Canada

[21] Appl. No.: 689,098

[22] Filed: Jul. 30, 1996

[51] Int. Cl.[6] ..... B41F 13/24

[52] U.S. Cl. ..... 101/247; 101/479

[58] Field of Search ..... 101/247, 216, 101/219, 218, 479, 177, 184, 182, 185, 181

[56] References Cited

U.S. PATENT DOCUMENTS

| | | | |
|---|---|---|---|
| Re. 34,483 | 12/1993 | Bowman et al. | 101/247 |
| 3,610,144 | 10/1971 | Woessner | 101/216 |
| 3,611,924 | 10/1971 | Harrison . | |
| 3,789,757 | 2/1974 | Motter et al. . | |
| 4,138,944 | 2/1979 | Biggar, III | 101/247 |
| 4,384,522 | 5/1983 | Ehlers et al. | 101/247 |
| 4,394,835 | 7/1983 | Gertsch et al. . | |
| 4,413,541 | 11/1983 | Biggar, III | 101/247 |
| 4,462,311 | 7/1984 | Armelin . | |
| 4,934,264 | 6/1990 | Gansky et al. | 101/177 |
| 4,936,211 | 6/1990 | Pensavecchia et al. | 101/177 |
| 5,060,570 | 10/1991 | Braedle et al. | 101/247 |
| 5,074,205 | 12/1991 | Morgan | 101/247 |
| 5,272,974 | 12/1993 | Guarino et al. . | |
| 5,351,616 | 10/1994 | Gelinas et al. . | |
| 5,392,710 | 2/1995 | Li | 101/219 |
| 5,394,798 | 3/1995 | Simon et al. . | |
| 5,540,149 | 7/1996 | Hoge | 101/352 |
| 5,570,633 | 11/1996 | Schultz et al. | 101/182 |

*Primary Examiner*—Eugene H. Eickholt

*Attorney, Agent, or Firm*—Birch, Stewart, Kolasch & Birch, LLP.

[57] ABSTRACT

Interchangeable cassettes containing a blanket cylinder and a plate cylinder of varying circumferences can be located in a printing tower of an offset printing apparatus. An impression roller is journaled to a pair of sub-frame arms pivoted to the frame by means of a pivot shaft which extends through the gear side frame wall. The impression roller shaft extends through the gear side frame wall in an arcuate slot, and the impression gear meshes with the pivot shaft gear at all angles of displacement of the impression gear. A pivoting sub-frame includes exterior plates mounted to the pivot shaft and on the exterior of the frame walls. Hydraulic clamping devices can clamp the exterior sub-frame plates and the sub-frame arms to the frame wall.

13 Claims, 6 Drawing Sheets

PRINTING APPARATUS

BACKGROUND OF THE INVENTION

1. Field of the Invention

The present invention relates to a printing press and more particularly to an offset printing press of the type having replaceable cassettes.

2. Description of the Prior Art

An offset printing apparatus typically has a plurality of rotary towers, one for every colour and operation, such as perforating, numbering, etc. The web to be printed passes through the towers at high speed. Conventional printing towers have an assembly of inking rolls, a plate cylinder, and a blanket cylinder on one side of the web and an impression cylinder on the other side thereof. It is well known to provide replaceable cassettes on printing assemblies wherein the cassette contains the blanket cylinder and the plate cylinder. The purpose of such cassettes is to be able to relatively rapidly replace the plate and blanket cylinders that must be of different circumference for different print jobs, such as making up different length sheets. One or more of the cylinders must be movable to adjust to the different circumference cylinders.

For instance, U.S. Pat. No. 3,611,924, Harrison, issued Oct. 12, 1971, describes an offset press where the blanket cylinder is mounted on pivoting arms to bring the blanket cylinder into tangential contact with the plate cylinder and the impression cylinder. The impression cylinder is on a fixed axis. The arms mounting the blanket cylinder are driven by worm gears rotating the shaft on which the arms are mounted. The gears also lock the arms in position. U.S. Pat. Nos. 4,462,311, Armelin, issued Jul. 31, 1984, and 5,272,974, Guarino et al, issued Dec. 28, 1993, both describe offset printing presses that allow the plate cylinder to be adjusted, and the impression cylinder can be moved towards and away from the removable cassette containing the plate and blanket cylinders. U.S. Pat. No. 5,351,616, Gelinas et al, issued Oct. 4, 1994, describes pneumatic bladders for moving the impression cylinder into contact with the blanket cylinder.

The web travels at very high speeds. It is recognized that the cylinders and particularly the movable impression cylinder must be kept rigid in order to avoid any oscillations from occurring. It is also known that the blanket cylinder includes a seam that can provoke such oscillations with the impression cylinder. Thus, unless the impression cylinder is fixed to the frame, one or other of the cylinders will oscillate.

SUMMARY OF THE INVENTION

It is an aim of the present invention to provide a printing apparatus of the type using rotary printing cylinders to print on a continuous web of paper, wherein replaceable cassettes, each having at least a printing cylinder of differing circumference, are used in combination with an impression cylinder mounted on the frame of the printing apparatus whereby the impression cylinder can be moved to be adjacent the BLANKET cylinder.

It is a further aim of the present invention to provide an improved drive gear train for driving the cylinders in a replaceable cassette.

The present invention concerns a printing apparatus for processing a continuous web, comprising a frame including a pair of upstanding parallel frame walls, a replaceable cassette having a pair of side walls insertable in the frame with the side walls of the cassette in the same respective planes as the frame walls, at least a processing cylinder of a predetermined circumference in the cassette and extending between the side walls, a pair of pivotal sub-frame arms mounted to the frame with an arm adjacent each frame wall and adapted to rotate about a pivot axis extending laterally of the frame, an impression cylinder in the frame on the opposite side of the web relative to the processing cylinder, extending between the frame walls and journaled to the sub-frame arms for angular displacement relative to the frame, and clamp means associated with the frame walls and the sub-frame arms to lock the sub-frame arms to the frame walls and thereby fix the impression cylinder relative to the frame and in tangential contact with the processing cylinder.

In a more specific embodiment of the present invention, one of the frame walls represents the gear side frame wall and the other frame wall represents the operator's side frame wall. Drive means are located on the gear side frame wall on the same side of the web as the impression cylinder. The drive means drives a series of gears including a central gear journaled in the pivot axis of the sub-frame arms. An impression cylinder gear meshes with the central gear whereby the central gear will be in engagement with the impression cylinder gear in all angular displacements of the sub-frame arms, and the impression cylinder gear is adapted to be in meshing engagement with a processing cylinder gear on the cassette side wall corresponding to the gear side frame wall.

In a more specific embodiment of the present invention, the processing cylinder is a blanket cylinder, and a plate cylinder is in tangential contact with the blanket cylinder, while the impression gear meshes with a blanket cylinder gear and the blanket cylinder gear is in engagement with a plate cylinder gear.

In a more specific embodiment of the present invention, a selection of cassettes has processing cylinders of different circumferences, and the impression cylinder can be adjusted to be in tangential contact with the different processing cylinders by rotating the sub-frame arms.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
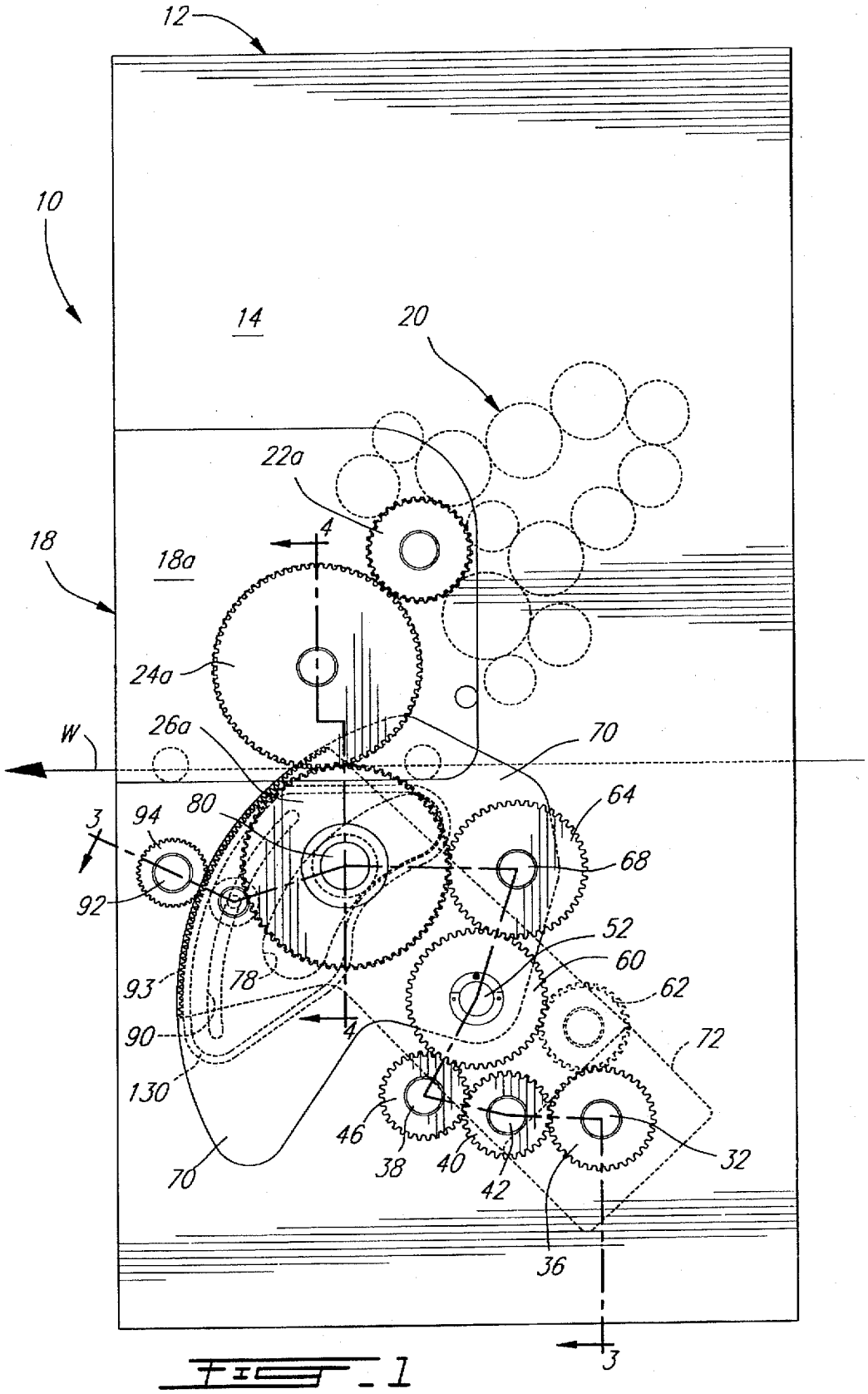
FIG. 1 is a side elevation of a tower for an offset printing press in accordance with the present invention.
Figure 3:
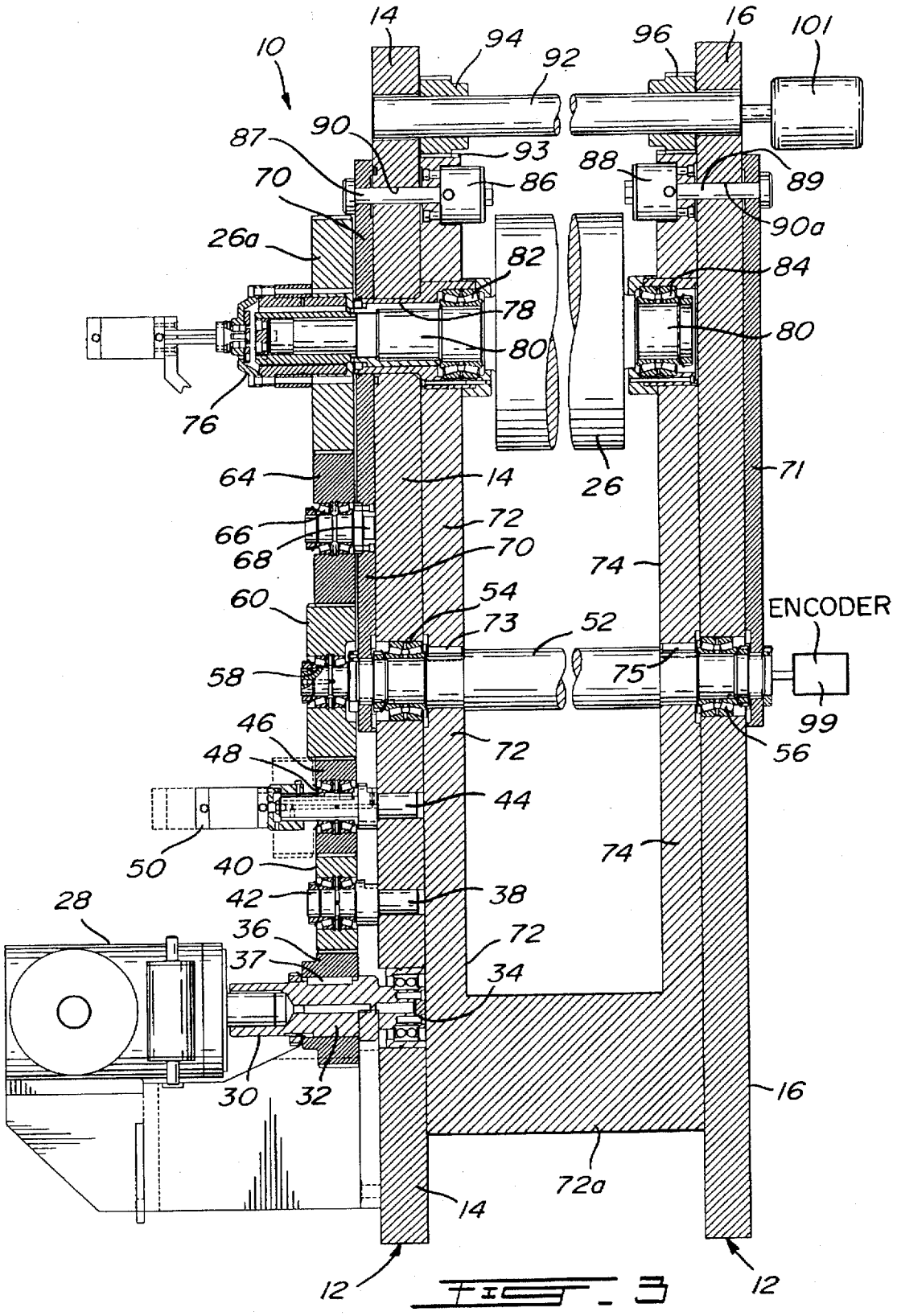
FIG. 3 is a cross-section taken along line 3—3 of FIG. 1.
Figure 4:
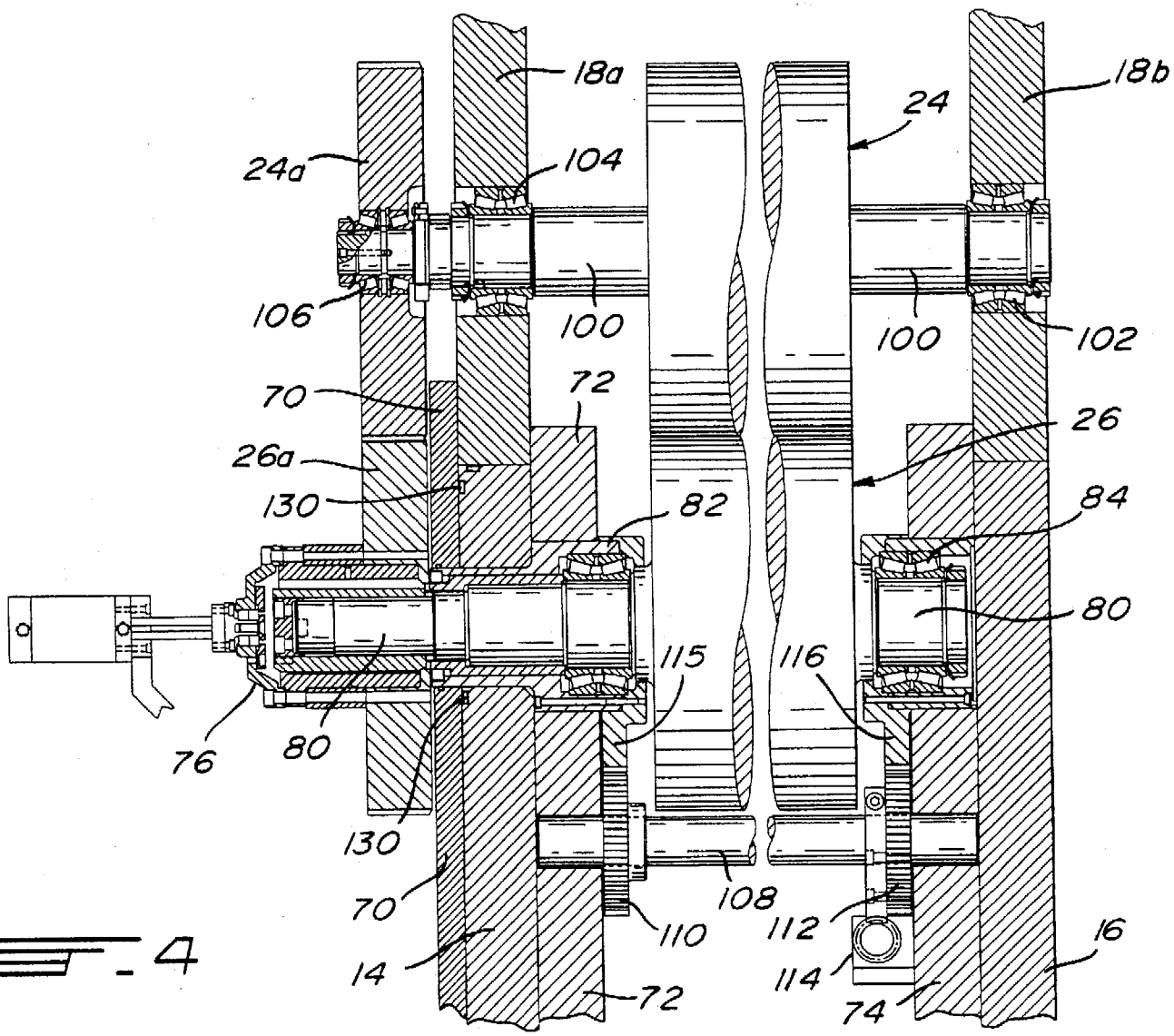
FIG. 4 is a vertical cross-section taken along line 4—4 of FIG. 1.

Reference will now be made to FIGS. 1, 3, and 4 of the drawings. In particular, the printing press tower 10 includes a frame 12 made up of a gear side frame wall 14 and an operator's side frame wall 16.

The tower 10 of the present embodiment includes a cassette 18 that includes a gear side wall 18*a* and an operator's side wall 18b which is meant to coincide with the cut-out portions in frame walls 14 and 16 respectively. A stack of ink rollers 20 is shown in FIG. 1. The ink rollers 20 are in tangential contact with plate cylinder 22 shown in dotted lines in FIG. 5 and represented by the plate cylinder gear 22a in FIG. 1. The plate cylinder 22 is in tangential contact with the blanket cylinder 24. Both the plate cylinder 22 and the blanket cylinder 24 are mounted in the cassette 18. A mobile impression cylinder 26 is mounted to the frame 12, as will be described, and is in tangential contact with the blanket cylinder 24. The web W is represented by the arrow that extends between the blanket roll 24 and the impression roll 26.

The gear train for the plate cylinder 22, blanket cylinder 24, and impression cylinder 26 is shown in detail in FIGS. 1 and 3. A gear drive transmission 28 is connected by coupling 30 to shaft 32. Shaft 32 is supported in a bearing 34 mounted to the frame wall 14. Gear 36 is keyed to the shaft 32. Gear 36 meshes with an idler gear 40 mounted by means of bearing 42 to stub shaft 38 which, in turn, is mounted in the frame wall 14.

An alternate gear 62 can also mesh with drive gear 36. Gear 40 meshes with pull gear 46. Gears 46 and 62 are pull gears represented by pull gear assembly 50 in FIG. 3. Pull gear 46, for instance, is mounted on a bearing 48 to stub shaft 44 and is designed to slide out of meshing engagement with gears 40 and 60 by means of the pull gear assembly 50. The out-of-engagement position is shown in dotted lines in FIG. 3. Gear 46 can mesh with gear 60 which is mounted to shaft 52 by means of a bearing 58.

Shaft 52 is journaled in frame walls 14 and 16 by means of bearings 54 and 56 respectively. Pull gears 62 or 46 are used alternately for front print or back print as required.

Figure 5:
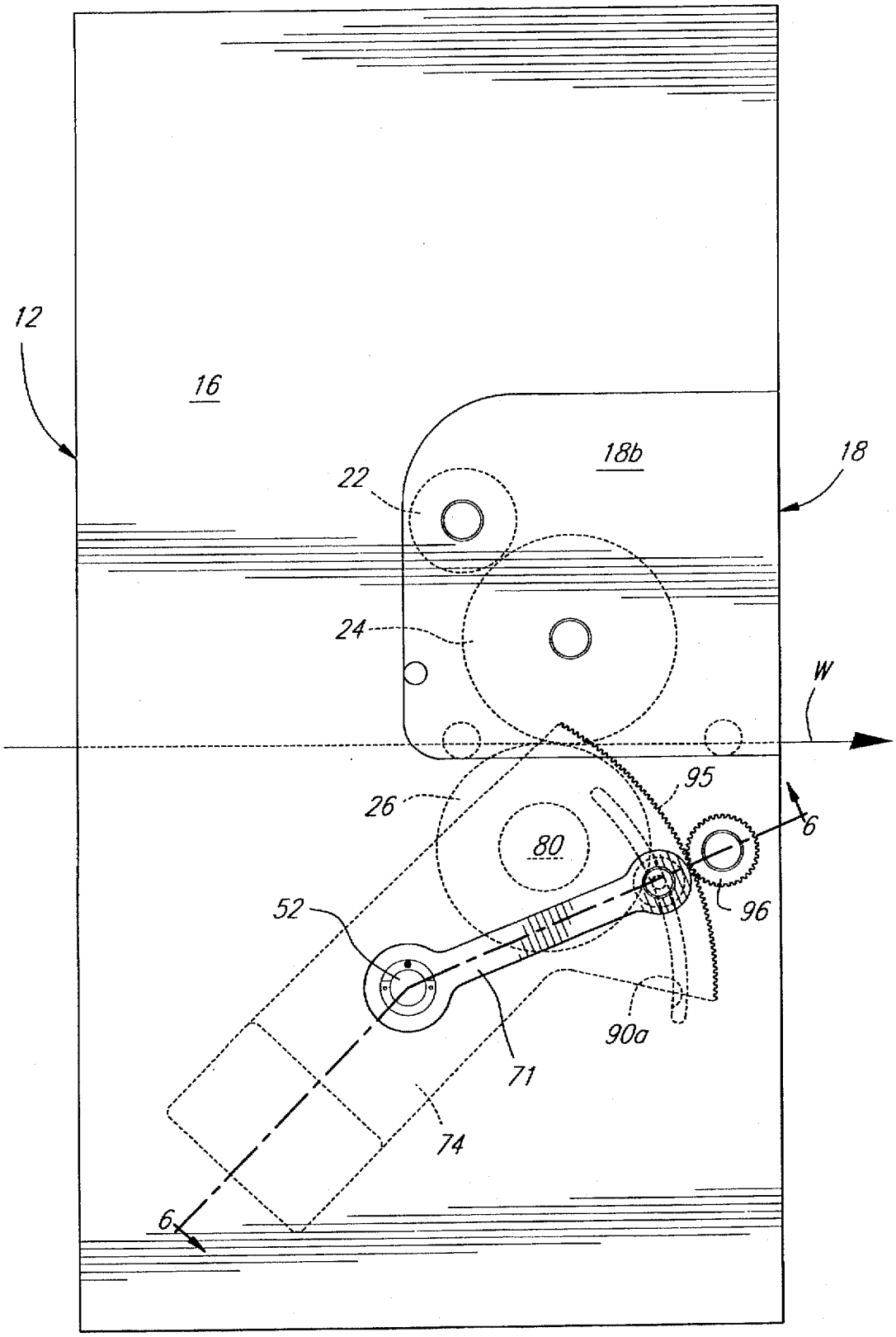
FIG. 5 is a side elevation of the tower shown in FIG. 1 but taken from the operator's side.
Figure 6:
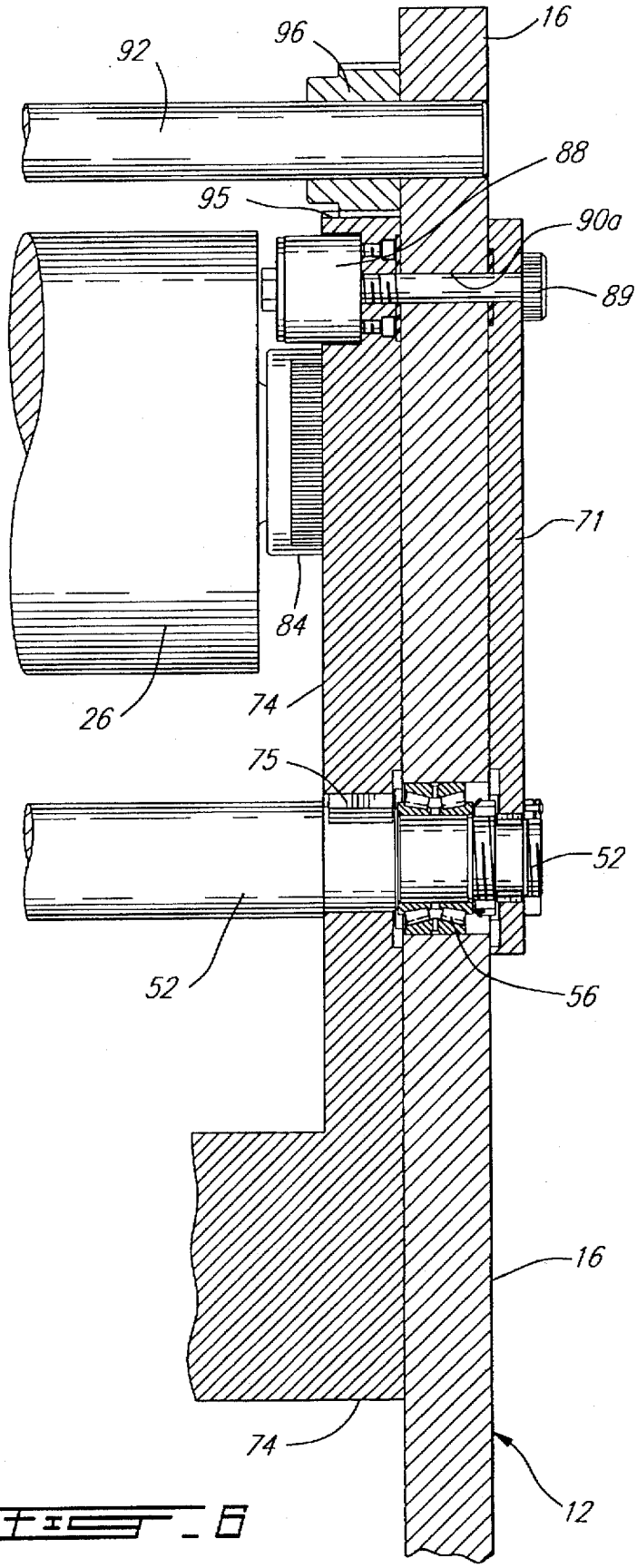
FIG. 6 is a fragmentary cross-section taken along line 6—6 of FIG. 5.

A pivoting sub-frame includes gear side pivot plate 70 which is keyed to the shaft 52 and will pivot about the axis of the shaft 52 in response to the angular rotational displacement of the shaft 52. A corresponding operator's side pivot plate 71 is located on the exterior of frame wall 16, as shown in FIGS. 3, 5, and 6. The pivot plate 71 is also keyed to the shaft 52 for rotary movement therewith. A pair of cantilevered arms 72 and 74 are fixed to the shaft 52 by means of keys 73 and 75 respectively for rotational movement about the axis of the shaft 52 in conjunction with the movement of the pivot plates 70 and 71. A counterweight 72a is provided between arms 72 and 74 in order to better balance the sub-frame.

An idler gear 64 is meshed with the gear 60 and is mounted to a stub shaft 68 fixed in the pivot plate 70 by means of a bearing 66. Gear 64 will be displaced with the sub-frame but will always be in tangential engagement with gear 60 on the pivot axis of the sub-frame.

Gear 26a is mounted with a pull gear assembly to shaft 80 whereby the gear 26a can be disengaged from being meshed with the gear 24a when it is desired to replace the cassette 18. The angle between the axis of gear 64, impression cylinder gear 26a, and blanket cylinder gear 24a can vary between 75° and 125°.

An arcuate slot 78 is cut out of the frame wall 14. Impression roll shaft 80 is journaled in the arm 72 by means of bearing 82 and in the arm 74 by means of bearing 84. When the sub-frame including arms 72, 74 and pivot plates 70, 71 rotates, the shaft 80 travels in the slot 78 formed in the wall 14. The angular displacement in the present embodiment is 50°.

As can be seen, the drive is directed from the lower part of the frame 12 through the impression cylinder 26 to the blanket cylinder 24. In many offset printing presses, the opposite occurs, and the drive emanates from the upper portion of the tower through the ink rollers, the plate cylinder and blanket cylinder, and then to the impression cylinder. The present arrangement avoids fluttering in backlash rotation of the impression cylinder.

Figure 2:
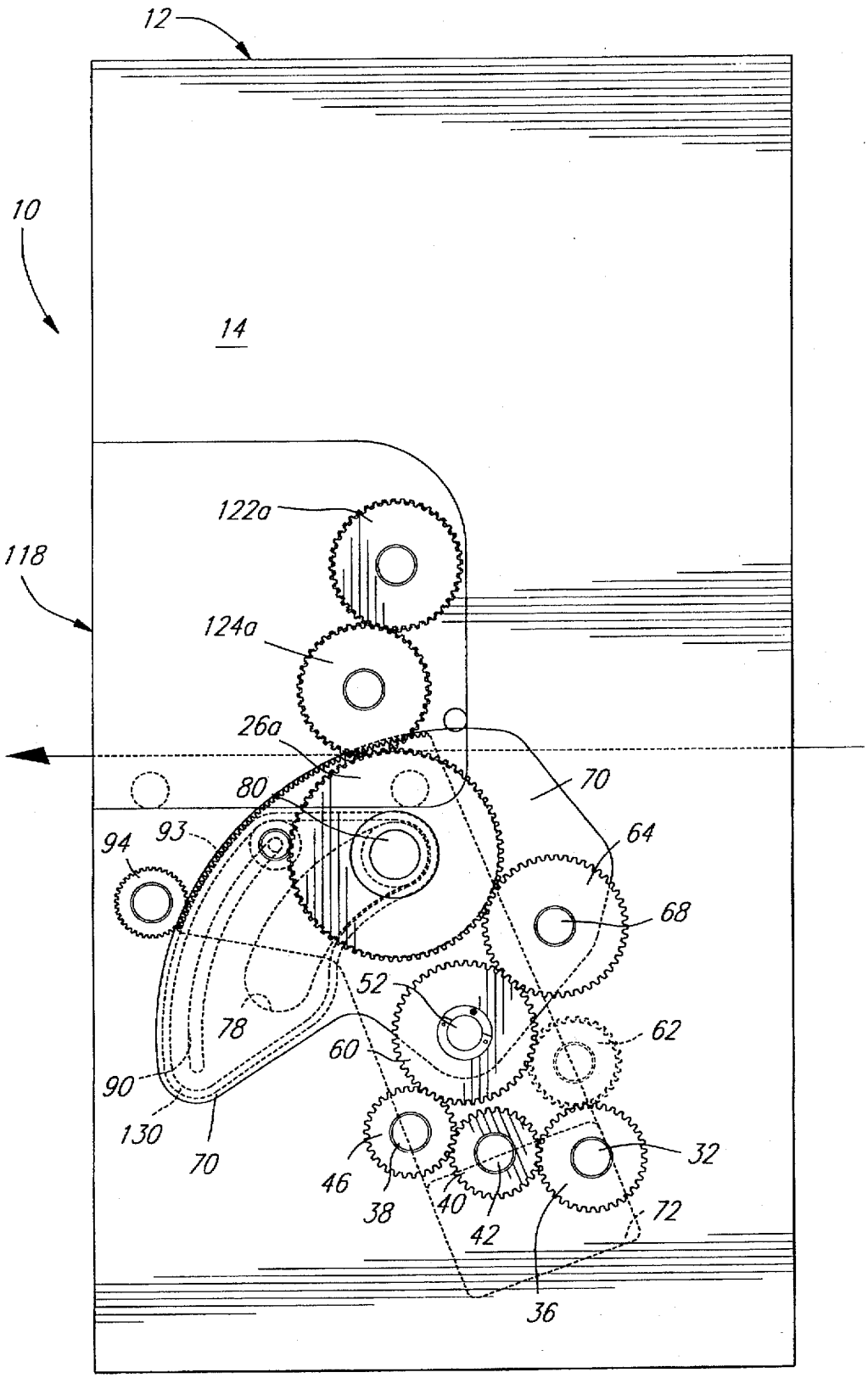
FIG. 2 is a side elevation, similar to FIG. 1, showing a different operative position of certain of the elements.

FIG. 2 shows the same tower as in FIG. 1 but with the cassette 118 replacing cassette 18. As can be seen, the plate roller is represented by the plate cylinder gear 122a and is of the same circumference as the blanket cylinder as represented by the blanket cylinder gear 124a. Since the circumference of the blanket cylinder in FIG. 2 is much smaller than the blanket cylinder 24 in FIG. 1, the impression cylinder 26 must be moved counterclockwise on the sub-frame with the shaft 80 traveling in the slot 78.

As seen in FIGS. 1, 2, and 3, the arms 72 and 74 include arcuate segment gears 93 and 95 on the upper edges thereof. The gears 93 and 95 are engaged by gears 94 and 96 mounted to drive shaft 92. Thus, the sub-frame, including impression cylinder 26, is displaced by driving drive shaft 92.

Once the sub-frame with the shaft 80 and impression cylinder 26 are in the desired position, that is, in tangential contact with a new blanket cylinder 124, the clamping cylinders 86 and 88 are activated, causing the pistons 87 and 89 to force the pivot plate 70 and arm 72 as well as pivot plate 71 and arm 74 to be clamped against the respective frame walls 14 and 16. Thus, when clamp cylinders 86 and 88 are activated, the impression roll 26 is fixed into position and cannot move relative to the frame walls 14 and 16. Arcuate slots 90 and 90a are provided in the frame walls 14 and 16 respectively in order to allow the pistons 87 and 89 to travel with the sub-frame.

As can be seen in FIG. 4, the bearings 82 and 84, of the shaft 80, have eccentric housings in the arms 72 and 74 respectively. The bearing housings are provided with segmental gears 115 and 116 which are engaged by gears 110 and 112 respectively, fixedly mounted to shaft 108 which, in turn, can be displaced by means of a drive 114. Thus, the impression cylinder 26 can be subject to fine adjustment, once the arms 72 and 74 have been locked in place by clamping cylinders 86 and 88.

Thus, the impression cylinder 26 can be positioned to different arrangements of sizes of plate and blanket cylinders of different cassettes 18, 118, etc. However, once the impression cylinder 26 is positioned with respect to the blanket cylinder 24 or 124, it can be locked in that position. The gear 26a is pulled away from engagement with gear 24a when it is required to change the cassette.

The arm 72 and pivot plate 70 of the sub-frame are designed to cover slot 78 of wall 14, in all angular displacements of the sub-frame.

A pneumatic seal 130 is provided in the frame wall 14 between the frame wall and the pivot plate 70. Thus, when the pivot plate 70 is locked in position, the pneumatic seal 130 may be activated in order to seal the lubrication surrounding the gears of shaft 80.

The sub-frame represented by the arms 72 and 74 with the pivot plates 70 and 71 can move within an angle of 50°. Typically, the radius of the shaft 80 is 10.5 inches.

Reference position holes can be provided between the sub-frame and the frame. A digital knob pot is provided on each cassette which is connected to a computer. Also, an encoder 99 is mounted to the end of shaft 52 in order to provide the information on the angular position of the shaft 52. A computer analyzes this information as well as the information coming from the digital knob pot on the sub-frame and then can direct the servo motor 101 to position the arms 72 and 74 and, therefore, the impression cylinder 26 and gear 26*a*. The computer will also control a motor (not shown) which will operate the drive 114 to provide micro adjustment of the position of the impression cylinder 26 and gear 26*a* to properly mesh with the gear 24*a* of the new blanket roll.

We claim:

1. In a printing apparatus for printing on a continuous web, a processing tower comprising a frame including a pair of upstanding parallel frame walls, a replaceable cassette having a pair of side walls insertable in the frame with the side walls of the cassette in the same respective planes as the frame walls, at least a processing cylinder of a predetermined circumference mounted in the cassette and extending between the side walls, a pair of pivotal sub-frame arms mounted to the frame with an arm adjacent each frame wall and adapted to rotate about a pivot axis extending laterally of the frame, an impression cylinder in the frame, on the opposite side of the web relative to the processing cylinder, extending between the frame walls and journaled to the sub-frame arms for angular displacement relative to the frame, and clamp means associated with the frame walls and the sub-frame arms to lock the sub-frame arms to the frame walls and thereby fix the impression cylinder relative to the frame and in tangential contact with the processing cylinder.

2. In the printing press as defined in claim 1, the processing tower is a printing tower and the processing cylinder in the cassette is a blanket cylinder, the cassette being interchangeable with other cassettes having blanket cylinders of different circumferences, and the impression cylinder on the sub-frame arms can be displaced to be in tangential contact with the blanket cylinder of the different interchangeable cassettes.

3. In the printing apparatus as defined in claim 2, wherein the interchangeable cassettes each have at least a plate cylinder and a blanket cylinder of predetermined circumferences, and inking rolls are mounted to the frame walls and are in tangential contact with the plate cylinder of the interchangeable cassettes.

4. In the printing apparatus as defined in claim 1, wherein a shaft extends along the pivot axis and is journaled in the frame walls, and the sub-frame arms are fixedly mounted to the shaft, the shaft extending beyond the frame walls and the sub-frame arms being adjacent the frame walls on the interior of the frame while sub-frame plates are fixedly mounted to the shaft on the exterior of the frame walls and are adjacent the frame walls and rotate in concert with the sub-frame arms.

5. In the printing apparatus as defined in claim 4, wherein the clamp means includes a hydraulic cylinder and piston associated with each sub-frame arm and the corresponding sub-frame plate on the exterior of the frame wall, whereby when the piston and cylinder are actuated, the sub-frame plate and sub-frame arm are drawn towards each other against the corresponding frame wall in order to clamp the sub-frame plate and the sub-frame wall on the frame wall.

6. In the printing apparatus as defined in claim 5, wherein arcuate slots are provided in the frame wall coincident with the clamp means such that the piston of the hydraulic clamp means extends through the frame wall and can travel in the slot.

7. In the printing apparatus as defined in claim 5, wherein the impression cylinder is fixedly mounted to a shaft, and the impression cylinder shaft is journaled to the sub-frame arms in bearings, wherein the bearings include bearing housings and the bearing housings are eccentrically mounted in the sub-frame arms such that rotation of the bearing housings causes fine displacement of the impression cylinder once the sub-frame arms have been clamped to the frame walls.

8. In the printing apparatus as defined in claim 4, wherein the sub-frame arms are each provided with an arcuate gear segment and gear means are provided to rotate the sub-frame arms to cause angular displacement thereof about the pivot axis.

9. The printing apparatus as defined in claim 1, wherein one of the frame walls represents a gear side frame wall and the other frame wall represents the operator's side frame wall, and drive means are provided on the gear side frame wall on the same side of the web as the impression cylinder, the drive means driving a series of gears including a central gear journaled in the pivot axis of the sub-frame arms on the gear side frame wall, an impression cylinder gear adapted to be driven by a central gear through an idler gear journaled to the sub-frame, whereby the central gear can be in engagement with the idler gear and thus the impression cylinder gear in all angular displacements of the sub-frame arms, and the impression cylinder gear being adapted to be in meshing engagement with a processing cylinder gear on the cassette side wall corresponding to the gear side frame wall.

10. In the printing apparatus as defined in claim 9, wherein the central gear is journaled to a shaft extending in the pivot axis that in turn is journaled to the frame walls, and the sub-frame arms are fixedly mounted to the shaft.

11. In the printing apparatus as defined in claim 10, wherein the impression cylinder is fixedly mounted to an impression roller shaft which is journaled to the sub-frame arms, the impression cylinder shaft extends through an arcuate slot defined in the gear side frame wall, and the impression cylinder gear is fixedly mounted to the impression cylinder shaft, whereby the shaft can travel in the slot a distance corresponding to the maximum angular displacement of the impression cylinder.

12. In the printing apparatus as defined in claim 11, wherein the impression cylinder can be displaced through an angle of 50°.

13. In the printing apparatus as defined in claim 11, wherein the angle between the idler gear on the sub-frame, the impression cylinder gear, and the processing cylinder gear can vary between 75° and 125°.

* * * * *